US007859857B2

(12) United States Patent
Bucciferro

(10) Patent No.: US 7,859,857 B2
(45) Date of Patent: Dec. 28, 2010

(54) GROUNDING APPARATUS

(75) Inventor: Robert G Bucciferro, Joliet, IL (US)

(73) Assignee: Panduit Corp., Tinley Park, IL (US)

( * ) Notice: Subject to any disclaimer, the term of this patent is extended or adjusted under 35 U.S.C. 154(b) by 587 days.

(21) Appl. No.: 11/874,492

(22) Filed: Oct. 18, 2007

(65) Prior Publication Data

US 2008/0094774 A1 Apr. 24, 2008

Related U.S. Application Data

(60) Provisional application No. 60/862,060, filed on Oct. 19, 2006.

(51) Int. Cl.
*H01R 12/16* (2006.01)

(52) U.S. Cl. ..... 361/790; 361/794; 361/799

(58) Field of Classification Search ..... 361/790, 361/799, 752, 797, 800, 794
See application file for complete search history.

(56) References Cited

U.S. PATENT DOCUMENTS 4,917,615 A 4/1990 Franks, Jr.
D313,392 S * 1/1991 Sachs ..... D13/133
5,777,263 A 7/1998 Maehler et al.
5,797,756 A 8/1998 Nad
6,252,166 B1 6/2001 Leschinger
6,574,121 B1 6/2003 Franz et al.
6,652,295 B1 * 11/2003 Glass et al. ..... 439/94
6,877,996 B1 4/2005 Franks, Jr.

* cited by examiner

*Primary Examiner*—Hung S Bui
(74) *Attorney, Agent, or Firm*—Robert A. McCann; Christopher S. Clancy; Aimee E. McVady

(57) ABSTRACT

A grounding apparatus for connecting electrical equipment to ground comprises a plate comprising a top surface, a bottom surface and first and second end portions. Typically, the plate is connected to opposing support legs, such that an open space is provided under the bottom surface of the plate. The top surface of the plate may comprise one or more raised surfaces and also define a plurality of apertures for use in securing one or more lugs to the plate. The grounding apparatus optionally comprises a port connected thereto and comprising an exterior surface defining an opening for receiving a plug.

16 Claims, 5 Drawing Sheets

GROUNDING APPARATUS

This application claims priority to U.S. Provisional patent application No. 60/862,060, filed Oct. 19, 2006, the disclosure of which is hereby incorporated by reference in its entirety.

FIELD OF INVENTION

This invention relates to a grounding apparatus and, more particularly to a grounding apparatus that provides a common point and path to ground.

BACKGROUND OF THE INVENTION

Buildings, in particular office buildings, include electrical equipment and electrical connectors. Intricate pathworks of cables connect the electrical equipment and connectors. For example, cables connect electrical equipment located in a main equipment room to telecommunications equipment located in telecommunications rooms elsewhere in the building. Cables associated with the telecommunications equipment also extend into additional enclosures positioned in strategically placed zones throughout the different floors to establish electrical connections, such as ethernet connections.

These enclosures, called 'zone boxes,' house electrical equipment and connectors to receive cables extending from the telecommunications equipment, typically positioned in locations remote from the zone boxes. Additional cables may be extended out of zone boxes to other enclosures, such as data cables and racks for housing electrical equipment and to a mix of local devices, such as personal computers, printers, workstations and certain video cameras.

To prevent damage to electrical equipment and ensure the safety of its users and maintainers, a path to ground must be provided. The path to ground enables static electrical charges that may build up in the equipment during its operation to be safely discharge without harming a user or maintainer of the equipment. A maintainer of electrical equipment should maintain contact with a path to ground during maintenance and repair work in order to avoid the possibility of discharging static electricity into the equipment, potentially damaging the equipment.

There is a need, therefore, for a grounding apparatus that can be used as a path to ground for the electrical equipment and connections.

SUMMARY OF THE INVENTION

The present invention relates to an improved grounding apparatus and methods for using the same.

In one embodiment, the grounding apparatus comprises a plate comprising a top surface, a bottom surface and first and second end portions, the top surface of the plate for receiving one or more lugs a plurality of apertures defined by the plate and one or more raised surfaces formed on the top surface and comprising opposing wall members, at least one of the raised surfaces positioned between two of the apertures.

In another embodiment, the grounding apparatus comprises a plate, a plurality of apertures defined by the plate, one or more raised surfaces formed on the plate and opposing support legs. The plate comprises a top surface, a bottom surface and first and second end portions, with the top surface of the plate for receiving one or more lugs. The one or more or more raised surfaces are formed on the top surface of the plate and positioned adjacent the apertures. The raised surfaces comprise opposing wall members for opposing lateral movement of the one or more lugs when the lugs are positioned on the top surface of the plate. The opposing support legs are connected to the plate and positioned transversely thereto, such that an open space is provided under the bottom surface of the plate.

In still another embodiment, the grounding apparatus comprises a plate, opposing support legs and a port. The plate of this embodiment comprises a top surface, a bottom surface and first and second end portions, the top surface of the plate for receiving one or more lugs. The opposing support legs are connected to the plate and positioned transversely thereto, such that an open space is provided under the bottom surface of said plate. The port of this embodiment is connected to the grounding apparatus and comprises an opening for receiving a plug associated with an electrostatic discharge device.

The grounding apparatus of the present invention may incorporate various other features. The raised surfaces may be spaced apart from the end portions of the plate and each wall member may be positioned adjacent to one of the apertures. Further, the raised surface may comprise a thickness greater than a thickness of the lug securable to the aperture—for example between about 0.025 inches and 0.100 inches and, more particularly, between about 0.060 inches and about 0.0990 inches. When the port is employed it may be positioned in an angular relationship relative to the plate. The apparatus may further comprise a washer comprising a plurality of teeth and a mounting flange comprising an aperture for securing the apparatus to a surface. The mounting flange may extend from one of the support legs, with a toe extending from the opposite support leg, with the toe and mounting flange positioned in different planes. The top surface of the plate may further comprise grooved sections positioned about the apertures.

Additionally, the grounding apparatus may be installed within a zone box comprising electrical equipment. In this case, wires secured to the electrical equipment, typically through a tap hole, connect to a lug, which, in turn, connects to the grounding apparatus. In a zone box housing electrical equipment, the improvement comprises a grounding apparatus positioned within the zone box and connected to the electrical equipment. The grounding apparatus may comprise a plate comprising a top surface and a bottom surface, the top surface adapted to receive and hold one or more lugs comprising wires connecting the apparatus to the electrical equipment. The grounding apparatus may further comprise a port associated with the plate, the port comprising an opening for receiving a plug associated with an electrostatic discharge device.

BRIEF DESCRIPTION OF THE DRAWINGS

Certain embodiments of the present invention are illustrated by the accompanying figures. It should be understood that the figures are not necessarily to scale and that details not necessary for an understanding of the invention or that render other details difficult to perceive may be omitted. It should be understood, of course, that the invention is not necessarily limited to the particular embodiments illustrated herein.

DETAILED DESCRIPTION

Figure 1:
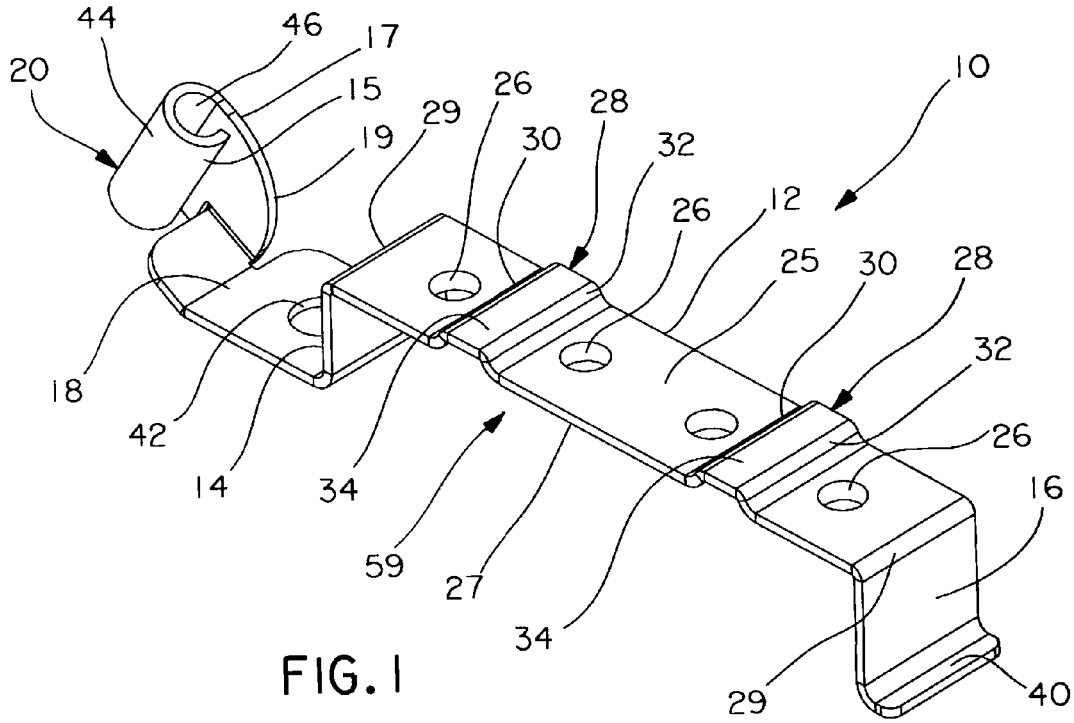
FIG. 1 is a perspective view of one embodiment of the grounding apparatus of the present invention.
Figure 2:
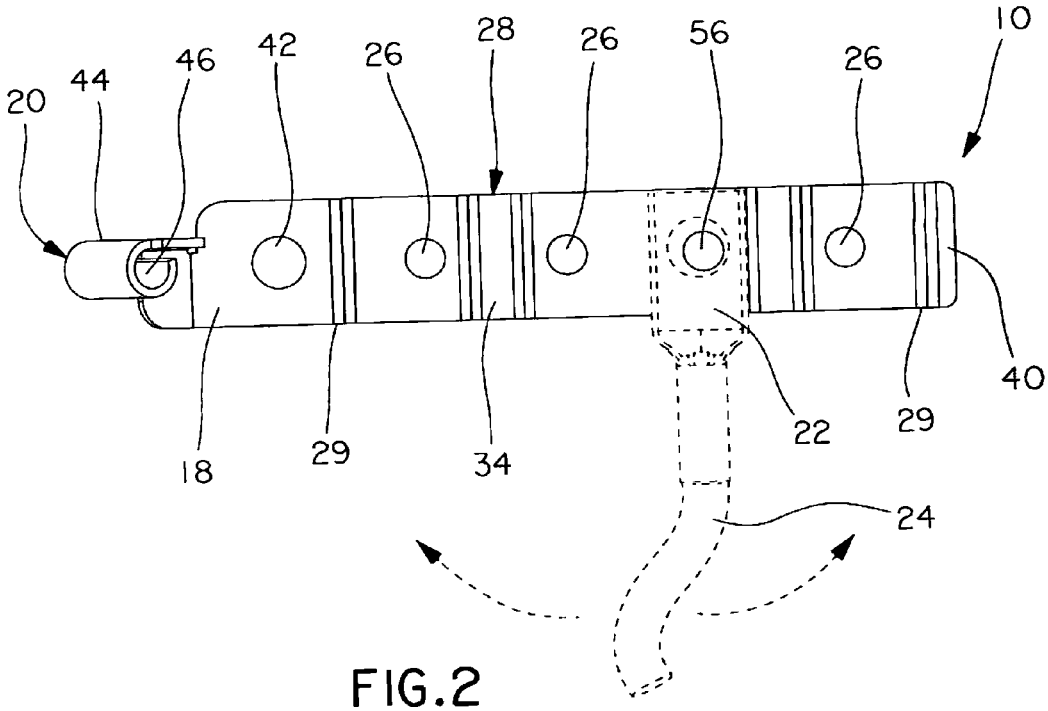
FIG. 2 is a top plan view of FIG. 1, with a lug and wire shown in phantom.
Figure 3:
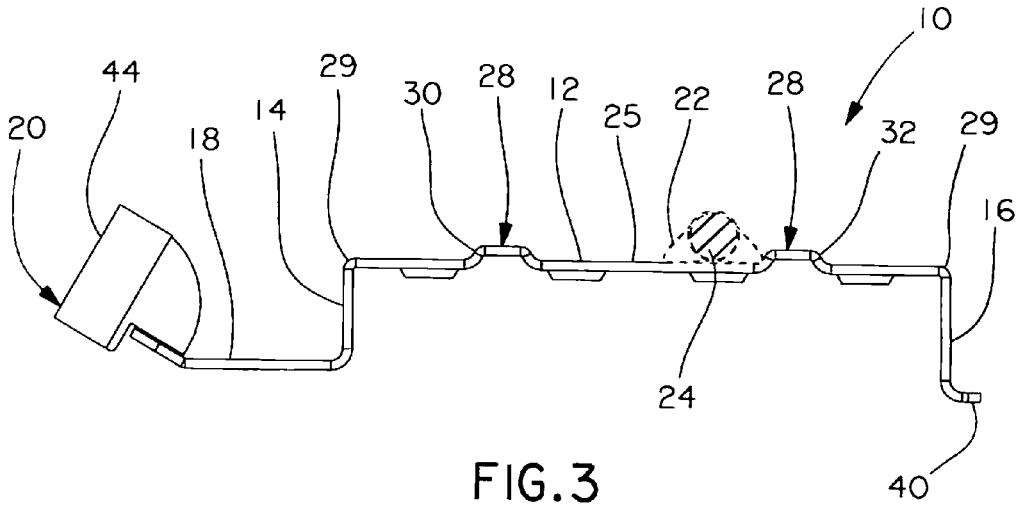
FIG. 3 is an elevated side view of FIG. 2.

Referring to FIGS. 1-3, grounding apparatus 10 comprises plate 12, support legs 14 and 16 and mounting flange 18. Grounding apparatus 10 optionally comprises port 20 and may also be used in combination with washer 21. Grounding apparatus 10 may be compact so it can be used in a plurality of enclosures. Typical measurements include about 0.5 inches to about 1.0 inches in width, about 2.5 inches to about 4.5 inches in length and about 0.25 inches to about 0.75 inches in height.

Plate 12, which typically comprises a length dimension that exceeds its width dimension is adapted to receive one or more lugs 22 comprising wires or cables 24 with electrical connections. Plate 12 may, therefore, define at least one aperture 26 for receiving a fastener that releasably secures lugs 22 to plate 12. Typically, a plurality of spaced apart apertures 26 comprising internal threads are positioned along the length of plate 12. Depending on lug 22 width, spacing of apertures 26 may vary between about 0.35 inches and about 0.85 inches and, more particularly, between about 0.60 inches and about 0.70 inches.

Plate 12 comprises top surface 25 and bottom surface 27 and terminates in end portions 29. Top surface 25 comprises raised surface 28. In one embodiment, illustrated in FIGS. 1-3, raised surface 28 is positioned adjacent and between two apertures 26. Raised surface 28 comprises opposing sidewalls 30 and 32 and top surface 34. Typically, opposing sidewalls 30 and 32 comprise a height between about 0.025 inches and 0.100 inches, which is the same or greater than the thickness of lug 22. In another embodiment, shown in FIG. 4, raised surfaces 28 and apertures 26 form an alternating pattern, such that a plurality of grooves 36 is positioned about apertures 26. The plurality of grooves 36 receive one or more lugs, which may be secured to top surface 25 of plate 12. Grooves 36 are typically sized and shaped to conform to the dimensions of lug 22.

Figure 4:
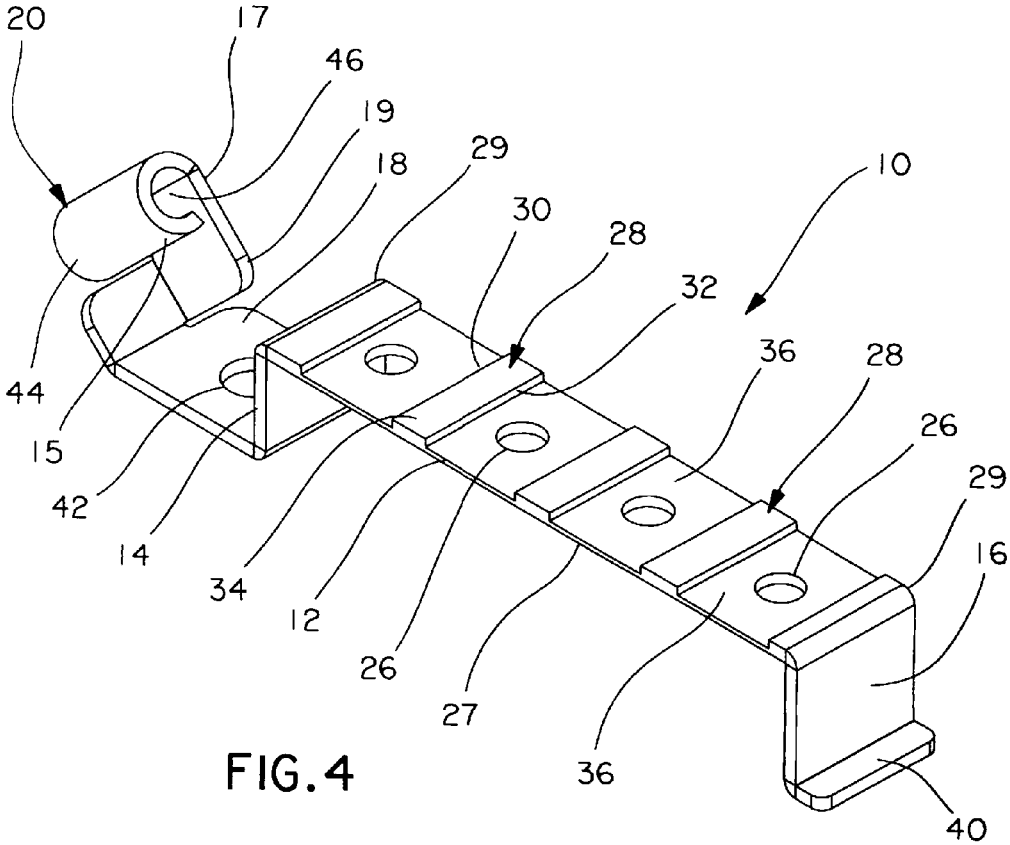
FIG. 4 is a perspective view of an alternate embodiment of the grounding apparatus of the present invention.
Figure 5:
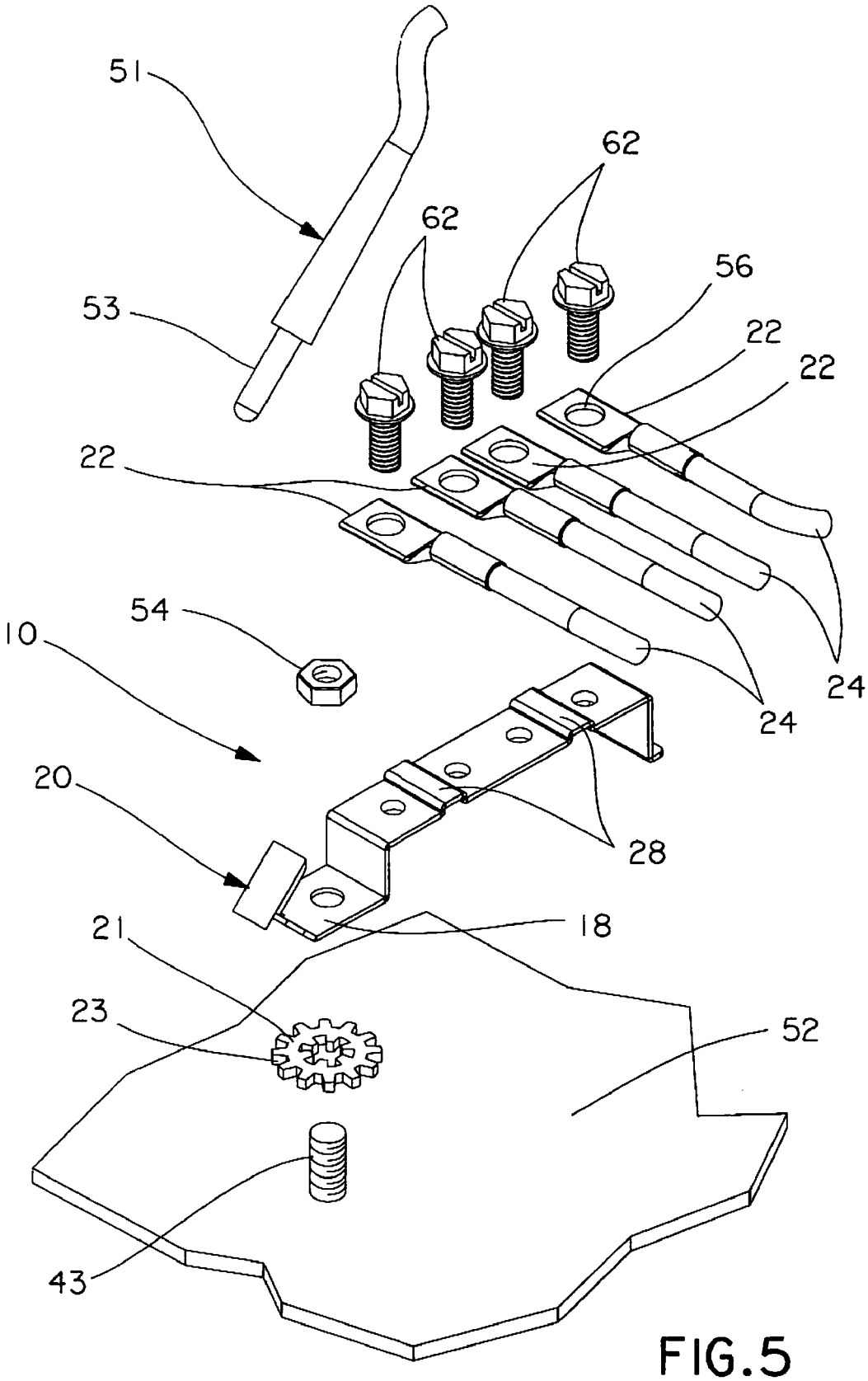
FIG. 5 is a perspective exploded view of installation of the grounding apparatus of the present invention on a surface comprising a stud for mounting.
Figure 6:
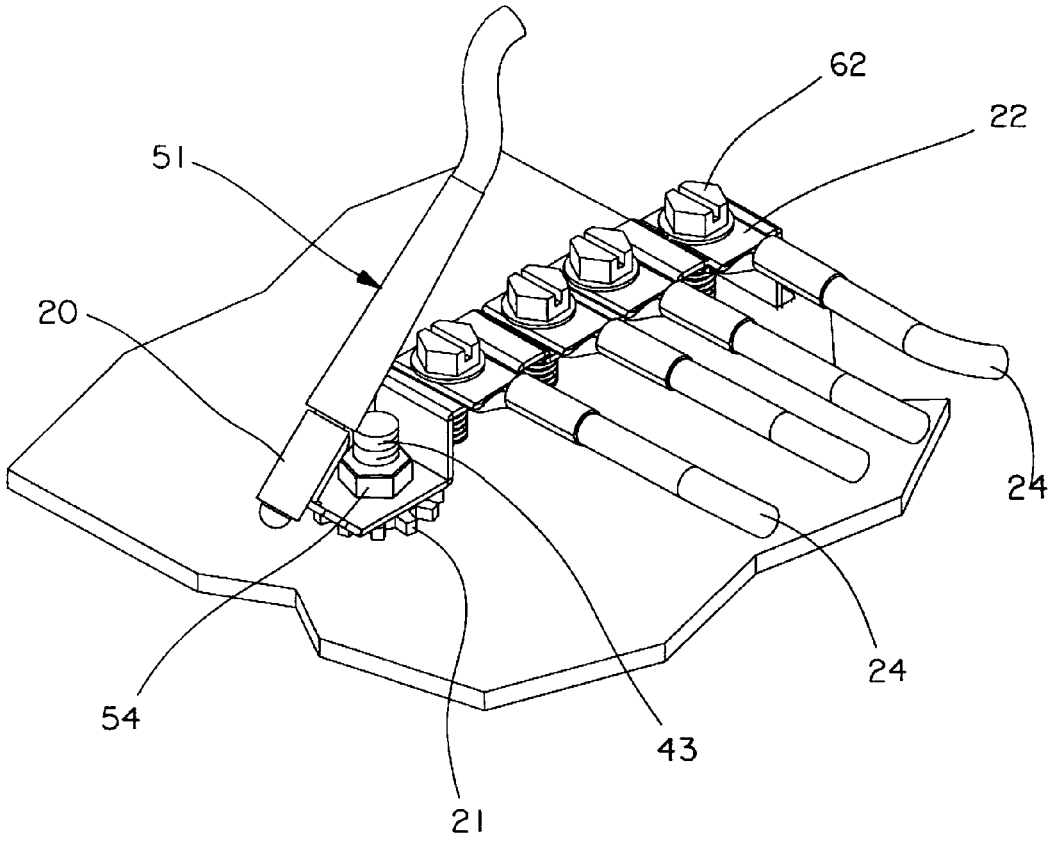
FIG. 6 is a perspective view of FIG. 5 after installation.

Support legs 14 and 16 may be positioned transversely to plate 12 and are typically connected to mounting flange 18 and toe 40. As best seen in FIGS. 4 and 5, mounting flange 18 may comprise hole or slot 42 for receiving stud 43 to secure grounding apparatus 10 to another structure. When washer 21 is employed mounting flange 18 may be positioned in a different plane than toe 40, such that apparatus 10 remains level when washer 21 is placed under mounting flange 18. Washer 21 typically comprises a plurality of spaced apart paint clearing teeth 23 positioned around its perimeter. Washer 21 may or may not be permanently affixed to or integral with a bottom surface of mounting flange 18.

Port 20 is adapted to receive the plug of a standard electrostatic discharge device, such as an electrostatic discharge wrist strap ("ESD strap"). ESD straps are known in the art and typically comprise a wrist strap connected to a length of wire, which connects to an electrically conductive cylindrical plug. Once the plug is secured to a grounding device, such as grounding apparatus 10, the ESD strap completes the path to ground to properly dissipate static electricity that may have accumulated in the body of the wearer of the ESD strap.

Port 20 may extend from first end portion 15 through curvilinear exterior surface 44 into straight portion 17 and terminate in second end portion 19, thereby defining opening 46. Port 20 may connect to grounding apparatus 10 in various locations. As shown in FIGS. 1-3, port 20 is positioned on mounting flange 18 in an angled relationship thereto. Port 20 is typically integrally formed or stamped with apparatus 10. Relative to mounting flange 18 or plate 12, port 20 may be angled between about 25.0 and about 75.0 degrees, with 45.0 degrees being typical. This arrangement makes it convenient for users to secure an ESD strap to grounding apparatus 10. Of course, port 20 may be positioned elsewhere and in other configurations on grounding apparatus 10, such as on support legs 14 and 16 or toe 40.

Grounding apparatus 10 is typically constructed of any electrically conducting material, such as tin-plated copper or bare copper. Apparatus 10 may be formed or stamped.

Figure 7:
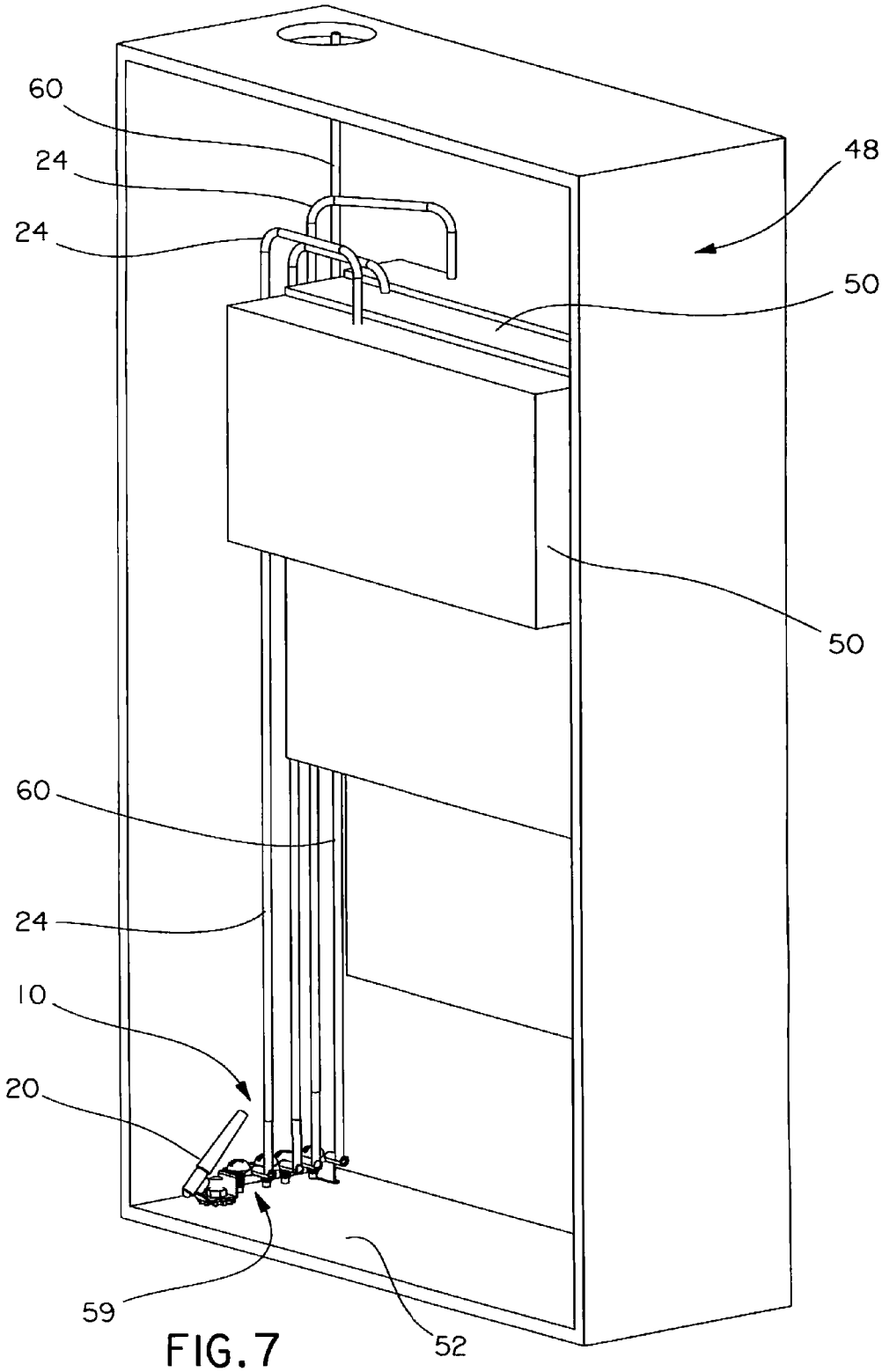
FIG. 7 is a perspective view of the grounding apparatus of the present invention installed in a zone box and connected to a grounding wire.

In operation, grounding apparatus 10 may be employed with any device comprising electrical equipment or electrical connections, such as a zone box, data cabinet or rack. FIG. 7 illustrates use of grounding apparatus 10 with zone box 48. Zone box 48 comprises electrical equipment 50 and wires 24.

Installation of apparatus 10 is accomplished through mounting flange 18, which is typically positioned proximate the user when a door of zone box 48 is open. Depending on whether zone box 48 comprises stud 43 and whether washer 21 is employed, the installation process is variable. When stud 43 is present and washer 21 is employed, washer 21 is positioned over stud 43, such that teeth 23 contact interior surface 52 of zone box 48. Stud 43 is thereafter placed through mount hole or slot 42 and apparatus 10 is secured into position with nut 54. When stud 43 is not present, interior surface 52 of zone box 48 comprises an opening for receiving a fastener (not shown). In this case, washer 21 is placed over the opening and mount hole 42 is aligned therewith. A fastener may thereafter be threaded through mount hole 42, washer 21 and the opening in the interior surface 52 to secure apparatus 10 to zone box 48. Installation may also occur in the absence of washer 21. In this case, mount 18 and toe 40 lie in the same plane, and mount 18 is secured directly to interior surface 52.

Prior to or after installation, lugs 22 comprising wires 24 connected to electrical equipment 50 within zone box 48 may be secured to plate 12 through apertures 26. As shown in FIG. 5, openings 56 within lugs 22 are aligned with apertures 26, and lug fastener 62, such as a machine screw, is used for securement. Raised surfaces 28 help prevent lugs 22 from rotating during installation, and may also help prevent loosening of lugs 22 after installation—for example, when users pull on wires 24 connected to lugs 22. That is, lugs 22 typically lie flush against opposing sidewalls 30 and 32 of raised surface 28.

The presence of support legs 14 and 16 provides open space 59 between bottom surface 27 of plate 12 and interior surface 52 of zone box 48, affording clearance for lug fastener 62 during securement of lugs 22 so that fastener 62 does not bottom out on interior surface 52. Additionally, support legs 14 and 16 can help reduce unwanted movement of apparatus 10, both during installation and when users pull on wires 24 connected to lugs 22.

Port 20 may connect to ESD wrist strap 51 through cylindrical plug 53. A user simply places plug 53 in port 20 for the connection.

As shown in FIG. 7, apparatus 10 may also connect to grounding wire 60, which connects to a grounding system within the building. In this way, the electrical equipment 50 and wires 24 within zone box 48 are connected to a common ground. Grounding wire 60 typically connects to apparatus 10 through securement of lug 22 of apertures 26.

The invention claimed is:

1. A grounding apparatus comprising:

a plate comprising a top surface, a bottom surface and first and second end portions, said top surface of said plate for receiving one or more lugs;

a plurality of apertures defined by said plate;

one or more raised surfaces formed on said top surface of said plate, said raised surfaces positioned adjacent said apertures and comprising opposing wall members, said opposing wall members for opposing lateral movement of said one or more lugs when said lugs are positioned on said top surface of said plate; and opposing support legs connected to said plate and positioned transversely thereto, such that an open space is provided under said bottom surface of said plate.

2. The grounding apparatus of claim 1, wherein said apertures and raised surfaces form an alternating pattern, such that a plurality of grooves is positioned about said plurality of apertures, said plurality of grooves for receiving said one or more lugs.

3. The grounding apparatus of claim 1, wherein said one or more raised surfaces comprises a thickness between about 0.025 inches and 0.10 inches.

4. The grounding apparatus of claim 1, further comprising a port for receiving a plug associated with an electrostatic discharge device, said port positioned in an angular relationship to said plate.

5. The grounding apparatus of claim 1, further comprising a toe and a mounting flange for securing said grounding apparatus to a surface, each of said mounting flange and said toe connected to one of said support legs.

6. The grounding apparatus of claim 5, wherein said mounting flange and toe are positioned in different planes.

7. A grounding apparatus comprising:

a plate comprising a top surface, a bottom surface and first and second end portions, said top surface of said plate adapted to receive one or more lugs;

opposing support legs connected to said plate and positioned transversely thereto, such that an open space is provided under said bottom surface of said plate;

a plurality of raised surfaces positioned on said top surface, a plurality of apertures and said plurality of raised surfaces form an alternating pattern, such that a plurality of grooves is positioned about said plurality of apertures, said plurality of grooves for receiving said one or more lugs; and a port connected to said grounding apparatus, said port comprising an opening for receiving a plug associated with an electrostatic discharge device.

8. The grounding apparatus of claim 7, wherein said top surface of said plate comprises a plurality of apertures for use in connecting said one or more lugs to said top surface of said plate.

9. The grounding apparatus of claim 7, wherein said raised surfaces comprise opposing wall members capable of opposing lateral movement of said one or more lugs.

10. The grounding apparatus of claim 7, wherein said one or more raised surfaces comprises a thickness between about 0.025 inches and 0.10 inches.

11. The grounding apparatus of claim 7, further comprising a mounting flange connected to at least one of said opposing support legs, said mounting flange for securing said grounding apparatus to a surface and carrying said port.

12. The grounding apparatus of claim 7, further comprising a toe and a mounting flange for securing said grounding apparatus to a surface, each of said mounting flange and said toe connected to one of said support legs.

13. The grounding apparatus of claim 12, wherein said mounting flange and toe are positioned in different planes.

14. In a zone box comprising electrical equipment, the improvement comprising a grounding apparatus positioned within said zone box and connected to said electrical equipment, said grounding apparatus comprising a plate comprising a top surface and a bottom surface, said top surface adapted to receive and hold one or more lugs comprising wires connecting the apparatus to said electrical equipment, said plate is connected to a mounting flange for securing said grounding apparatus to said zone box, said grounding apparatus further comprising a port associated with said plate, said port comprising an opening for receiving a plug associated with an electrostatic discharge device.

15. The zone box of claim 14, wherein said port is positioned in an angular relationship to said plate.

16. A grounding apparatus comprising:

a plate comprising a top surface, a bottom surface and first and second end portions, said top surface of said plate adapted to receive one or more lugs;

opposing support legs connected to said plate and positioned transversely thereto, such that an open space is provided under said bottom surface of said plate;

a toe and a mounting flange for securing said grounding apparatus to a surface, each of said mounting flange and said toe connected to one of said support legs; and a port connected to said grounding apparatus, said port comprising an opening for receiving a plug associated with an electrostatic discharge device.

* * * * *